US005779564A

United States Patent [19]

Nakamura et al.

[11] Patent Number: 5,779,564

[45] Date of Patent: Jul. 14, 1998

[54] SOLID GOLF BALL

[75] Inventors: Atsushi Nakamura; Hisashi Yamagishi, both of Chichibu, Japan

[73] Assignee: Bridgestone Sports Co., Ltd., Tokyo, Japan

[21] Appl. No.: 770,172

[22] Filed: Dec. 19, 1996

[30] Foreign Application Priority Data

Dec. 20, 1995 [JP] Japan ..... 7-349136

[51] Int. Cl.[6] ..... A63B 37/06; A63B 37/12

[52] U.S. Cl. ..... 473/377; 473/372; 473/382; 473/383

[58] Field of Search ..... 473/377, 365, 473/372, 378, 383, 382

[56] References Cited

U.S. PATENT DOCUMENTS

| | | | |
|---|---|---|---|
| 5,439,227 | 8/1995 | Egashira et al. | 473/377 X |
| 5,452,898 | 9/1995 | Yamagishi et al. | 473/377 |
| 5,497,996 | 3/1996 | Catomiga | 473/365 |
| 5,695,413 | 12/1997 | Yamagishi et al. | 473/337 X |

*Primary Examiner*—George J. Marlo

*Attorney, Agent, or Firm*—Sughrue, Mion, Zinn, Macpeak & Seas, PLLC

[57] ABSTRACT

In a solid golf ball comprising a solid core and a cover and having a weight of 41–44.5 grams, the cover has a Shore D hardness of 40–53 degrees. The relationship between core hardness and cover hardness is optimized for shots at low head speeds of less than 40 m/sec.

6 Claims, 2 Drawing Sheets

SOLID GOLF BALL

BACKGROUND OF THE INVENTION

1. Field of the Invention

This invention relates to a solid golf ball and more particularly, to a solid golf ball which is improved in flight distance, feel and spin when hit at a relatively low head speed. It is thus suitable for golf players with a low head speed including beginner, female and senior players.

2. Prior Art

For golf balls, various proposals have been made for improving their flying distance and hitting feel. This is also true for solid golf balls.

Most of these advanced golf balls target those golf players who swing at a relatively high head speed of 45 m/sec. or higher, that is, experienced players. Then those golf players capable of high head speed swing can take advantage of the advanced balls, enjoying an increased flying distance and a pleasant feeling. However, those golf players having slow head speed, including beginner, female and senior players cannot take full advantages of the advanced balls including an increased flight distance and pleasant feel. The reason is that the flight performance is more dependent on a head speed since a weaker force applied to the ball upon impact causes a smaller deformation of the ball. Especially on shots with a driver and long iron, the ball is projected relatively low and follows a relatively low trajectory, failing to cover a long distance.

For those players with a low head speed, there are available golf balls having a core soft enough to take advantage of restitution. Since a low head speed player can impart only a small force to the ball upon impact, no sufficient restitution is available from a hard ball. For the ball with a soft core, a hard cover must be used when the restitution of the ball as a whole is considered. Then the ball has the structure that the core is soft and the cover is hard. The hard cover detracts from spin receptivity and renders the ball difficult to control upon approach shots with a sand wedge or #7 iron.

Thus simply using soft cores is not considered suitable for golf balls targeting low-head speed players. It is desirable to have a solid golf ball finding an appropriate compromise between core softness and cover hardness to be optimum for low-head speed players.

SUMMARY OF THE INVENTION

An object of the present invention is to provide a novel and improved solid golf ball which will exhibit an appropriate trajectory and flight performance for players with a low head speed and has sufficient spin receptivity to be easy to control upon approach shots.

According to the invention, there is provided a solid golf ball comprising a solid core and a cover. The cover has a Shore D hardness in the range of 40 to 53 degrees and the ball has a weight in the range of 41 to 44.5 grams. Preferably the solid core has a hardness corresponding to a distortion of 2 to 5 mm under a load of 100 kg.

BRIEF DESCRIPTION OF THE DRAWINGS

These and further features of the present invention will be apparent with reference to the following description and drawings, wherein.

DETAILED DESCRIPTION OF THE INVENTION

Through the research work, we have obtained the following findings.

(i) Upon hitting at a low head speed, a relatively light ball will fly higher and is expected to travel a longer distance because of a less influence of weight.

(ii) A relatively soft ball is suited for hitting at a low head speed. Since hitting at a low head speed gives a smaller force to the ball upon impact, a hard ball will undergoes a smaller amount of deformation which exacerbates restitution. In contrast, an appropriately soft ball is efficient to convert ball deformation into a reaction force which favorably serves for increasing the flying distance.

Figures 1A, 1B:
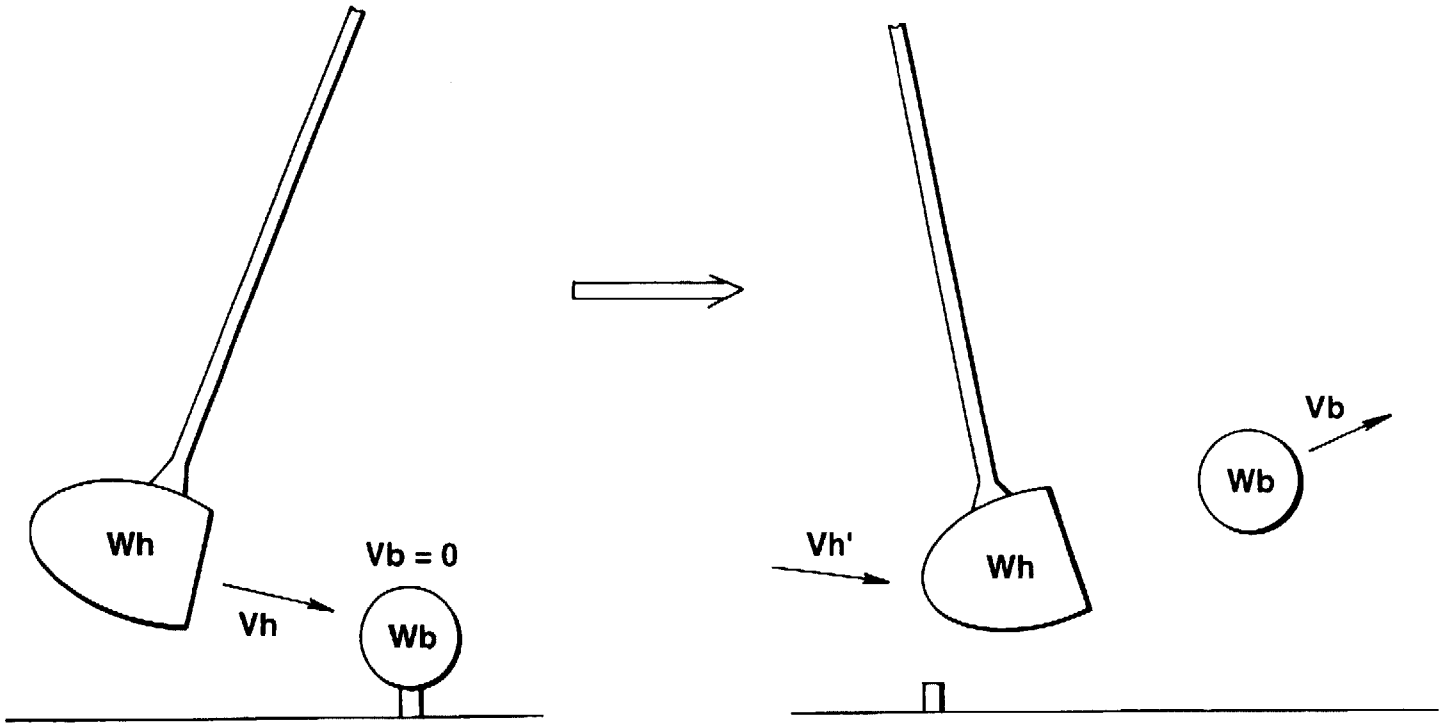
FIGS. 1 (*a*) and 1(*b*) are schematic views of a club head and a golf ball before and after impact, respectively.

(iii) The efficiency of restitution can be improved by reducing the weight of a ball as in (i). Referring to FIGS. 1(*a*) and 1(*b*), the relation between a club head and a ball upon impact is discussed. The club head has a weight Wh and is swung at a head speed Vh before impact and a head speed Vh' after impact. The ball has a weight wb and a stationary velocity Vb' (=0) before impact and is launched at an initial velocity Vb immediately after impact. The relation of kinetic energy between the club head and the ball gives equation (2).

$$WhVh = WhVh' + WbVb \tag{2}$$

The relation of restitution between the club head and the ball gives equation (3):

$$e = -\frac{Vb - Vh^1}{0 - Vh} \tag{3}$$

wherein e is a coefficient of restitution determined from the club and the ball. The initial velocity Vb of the ball is then determined from equations (2) and (3) and represented by equation (4).

$$Vb = Vh\frac{1+e}{1+(Wb/Wh)} \tag{4}$$

This suggests that the lower the ball weight Wb, the higher is the initial velocity Vb, provided that the head speed Vh and the club head weight Wh are fixed.

(iv) When it is desired to make the ball soft, the following problems arise with a solid golf ball of a two-piece structure consisting of a core and a cover or multi-piece structure. (a) If the core is made soft, it is generally difficult to insure restitution. A hard cover must then be used at the sacrifice of spin and feel. (b) In the case of (a), it would be effective to reduce the weight of the ball. This requires to reduce the percent loading of filler and increase the rubber fraction, which eventually leads to a soft core with high restitution. Then a soft cover can be used, leading to improvements in spin and feel. (c) It is generally believed that a softer cover leads to a higher spin rate and a shorter flight distance. Since the hardness (or softness) of the cover has a small influence on spin in the region of soft cores, making the cover relatively soft does not invite a shortage of flight distance.

Based on these findings (i) to (iv), the inventors made a study on a lightweight solid golf ball consisting essentially of a core and a cover in search of the relation between cover hardness and core hardness which is effective for not only improving spin receptivity and feeling upon approach, but also increasing restitution against impact at low head speeds so as to increase the flight distance. The inventors have found that in a lightweight solid golf ball comprising a solid core and a cover and having a weight of 41 to 44.5 grams, when the hardness of the core and the hardness of the cover are adjusted such that the cover has a Shore D hardness of 40 to 53 degrees and preferably the solid core has a hardness corresponding to a distortion of 2 to 5 mm under a load of 100 kg, the ball is not only improved in spin receptivity and feeling, but also increased in restitution against impact at low head speeds. An increase of flight distance is effectively accomplished. Additionally, the ball is easy to control upon approach shots with a sand wedge or #7 iron.

Now the present invention is described in further detail.

Figure 2:
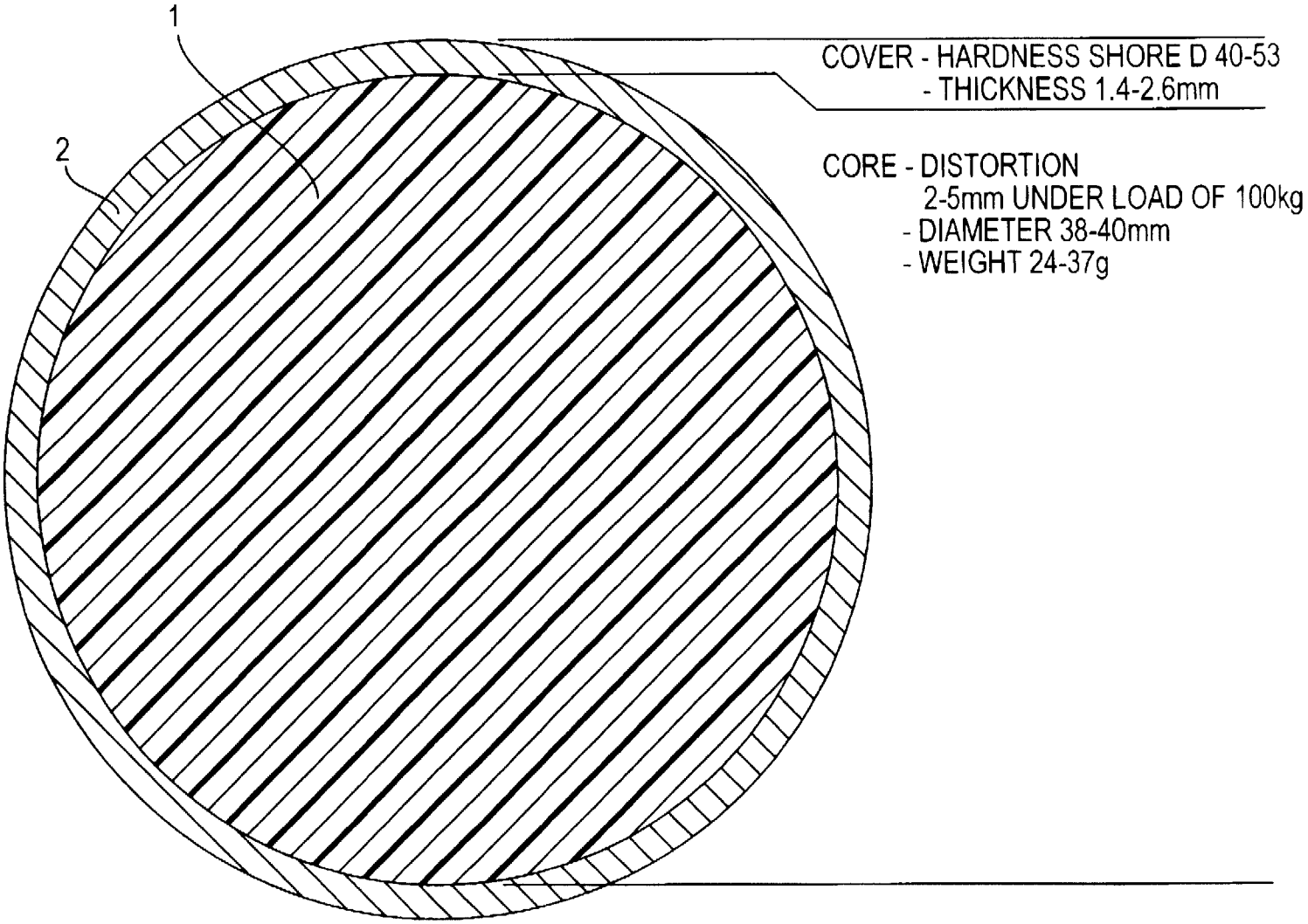
FIG. 2 is a cross section of a golf ball according to this invention.

As mentioned above, in connection with a lightweight solid golf ball 25 illustrated in FIG. 2 consisting essentially of a solid core 1 and a cover 2 enclosing the core, the present invention intends to improve the spin receptivity, feel and flying distance upon shots at low head speeds and to improve the controllability upon approach shots by optimizing the relation between cover hardness and core hardness. More specifically, adjustment is done on a lightweight solid golf ball having a weight of 41 to 44.5 grams such that the cover 2 has a Shore D hardness of 40 to 53 degrees and preferably the solid core 1 has a hardness corresponding to a distortion of 2 to 5 mm under a load of 100 kg.

The solid golf ball of the invention should have a weight of 41 to 44.5 grams, preferably 42 to 44 grams. Balls having a weight of less than 41 grams fly too high and are aerodynamically affected by the wind during flight, and fail to travel a long distance because of a too low inertia moment. Balls having a weight of more than 44.5 grams have no significant difference from conventional two-piece solid golf balls and cannot exert their performance upon low head speed hitting against the objects of the invention.

In the solid golf ball of the invention, the cover 2 should have a Shore D hardness in the range of 40 to 53 degrees, especially 43 to 53 degrees. A cover with a Shore D hardness of less than 40 degrees is too soft to provide an initial velocity and a flight distance. A Shore D hardness of more than 53 degrees exacerbates durability and spin characteristics and would reduce controllability upon approach shots. The gage of the cover 2 is not critical although it preferably has a gage (radial thickness) of 1.4 to 2.6 mm, especially 1.6 to 2.3 mm.

The hardness of the solid core 1 is not particularly limited although the solid core should preferably have a hardness corresponding to a distortion of 2 to 5 mm, especially 2.5 to 4.7 mm under a load of 100 kg. Cores with a distortion of less than 2 mm would be too hard, resulting in balls presenting unpleasant hitting feel and inadequate for low head speed hitting. Cores with a distortion of more than 5 mm would be too soft, losing restitution and durability. The diameter, weight and specific gravity of the solid core are not critical and may be properly adjusted insofar as the objects of the invention are attained. Usually the solid core 1 has a diameter of 38 to 40 mm, especially 38.2 to 39.7 mm and a weight of 24 to 37 grams, especially 25 to 35 grams.

As mentioned above, the golf ball of the invention is a solid golf ball having a solid core and a cover enclosing the core. It may be a two-piece solid golf ball or a three or multi-piece solid golf ball wherein the core or cover is composed of a plurality of layers. Better results are obtained with two-piece solid golf balls.

In the solid golf ball of the invention, the solid core 1 may be formed of any desired material by any desired method. Any of well-known materials may be used for the core insofar as a golf ball with desirable properties is obtained.

More particularly, the solid core of the solid golf ball according to the invention is formed from a conventional rubber composition by a conventional technique while properly adjusting vulcanizing conditions and formulation. Usually the core is formed of a composition comprising a base rubber, a crosslinking agent, a co-crosslinking agent, and an inert filler. The base rubber may be selected from natural rubber and synthetic rubbers used in conventional solid golf balls. The preferred base rubber is 1,4-polylbutadiene having at least 40% of cis-structure. The polybutadiene may be blended with natural rubber, polyisoprene rubber, styrene-butadiene rubber or the like. The crosslinking agent is typically selected from organic peroxides such as dicumyl peroxide and di-t-butyl peroxide, especially dicumyl peroxide. About 5 to 40 parts by weight of the crosslinking agent is generally blended with 100 parts by weight of the base rubber. The co-crosslinking agent is typically selected from metal salts of unsaturated fatty acids, inter alia, zinc and magnesium salts of unsaturated fatty acids having 3 to 8 carbon atoms (e.g., acrylic acid and methacrylic acid) though not limited thereto. Zinc acrylate is especially preferred. Examples of the inert filler include zinc oxide, barium sulfate, silica, calcium carbonate, and zinc carbonate, with zinc oxide and barium sulfate being often used. The amount of the filler blended is preferably 0 to about 30 parts by weight per 100 parts by weight of the base rubber although the amount largely varies with the specific gravity of the core and cover, the standard weight of the ball, and other factors. In the practice of the invention, the amount of the filler (typically zinc oxide and barium sulfate) is properly selected so as to provide the desired hardness and weight to the core.

A core-forming composition is prepared by kneading the above-mentioned components in a conventional mixer such as a Banbury mixer and roll mill, and it is compression or injection molded in a core mold. The molded core is then cured by heating at a sufficient temperature for the crosslinking agent and co-crosslinking agent to function (for example, a temperature of about 130 to 170° C. for a combination of dicumyl peroxide as the crosslinking agent and zinc acrylate as the co-crosslinking agent), obtaining a solid core.

The cover 2 enclosing the core is formed of a well-known composition, typically based on an ionomer resin. The ball parameters required by the invention are conveniently satisfied by a mixture of two or more ionomer resins. If desired, well-known additives such as titanium dioxide, barium sulfate, and magnesium stearate may be added to the ionomer resin for adjusting a specific gravity and hardness. UV absorbers, antioxidants and dispersing aids such as metal soaps may be added if desired. The cover composition may be molded over the solid core by any desired method, for example, by surrounding the core by a pair of preformed hemispherical cups followed by heat compression molding or by injection molding the cover composition over the core.

Like conventional golf balls, the golf ball of the invention is formed with a multiplicity of dimples in the cover surface. The ball is further subject to finishing steps including buffing, painting and stamping.

The solid golf ball of the invention is constructed as mentioned above. The diameter of the solid core and the gage of the cover are as defined above. The hardness and diameter of the ball as a whose are not critical although the ball preferably has a hardness as expressed by a distortion of 1.8 to 5.5 mm, especially 2.0 to 5.0 mm under a load of 100 kg. The ball should have a diameter in accordance with the Rules of Golf, that is, a diameter of at least 41.15 mm for the small size and at least 42.67 mm for the large size.

The solid golf ball of the invention is best suited for golfers who swing at a low head speed. The term "low head speed" means a head speed of less than 40 m/sec. when a driver (#1W) is used as a club. Therefore, the solid golf ball of the invention is best suited for golfers with a low head speed of less than 40 m/sec.

According to the present invention, a solid golf ball characterized by a relatively light weight and a relationship between solid core hardness and cover hardness optimized for low head speed hitting exhibits improved spin, feel and flight distance upon low head speed hitting. The ball is best suited for those golf players with a low head speed including beginner, female and senior players.

EXAMPLE

Examples of the present invention are given below by way of illustration and not by way of limitation. All parts are by weight.

Examples 1–4 & Comparative Examples 1–3

A solid core was prepared by milling a solid core-forming rubber composition of the formulation shown in Table 1 in a roll mill and vulcanizing it in a mold at 155° C. for about 20 minutes. A cover-forming composition of the formulation shown in Table 1 was then injection molded over the solid core, obtaining seven golf balls.

It is noted that the golf ball on the surface was formed with two types of large and small dimples arranged in an octahedral pattern so that the dimples occupied 65±3% of the entire surface area. This dimple arrangement should not be construed as limiting the invention.

TABLE 1

| | E1 | E2 | E3 | E4 | CE1 | CE2 | CE3 |
|---|---|---|---|---|---|---|---|
| Solid core (pbw) | | | | | | | |
| Cis-1,4-polybutadiene rubber | 80 | 85 | 80 | 90 | 100 | 80 | 100 |
| Polyisoprene rubber | 20 | 15 | 20 | 10 | | 20 | |
| Zinc acrylate | 30.0 | 26.0 | 24.5 | 22.0 | 23.5 | 25.0 | 20.0 |
| Zinc oxide | 10.0 | 6.0 | 3.0 | 19.0 | 23.0 | 11.5 | 3.0 |
| Dicumyl peroxide | 0.9 | 0.9 | 0.9 | 0.9 | 0.9 | 0.9 | 0.9 |
| Cover (pbw) | | | | | | | |
| Surlyn 8220 | | | | | | 50 | |
| Himilan 7315 | | | | | | 50 | |
| Himilan 1557 | 50 | 30 | 60 | 60 | 50 | | 30 |
| Himilan 1601 | | | | | 50 | | |
| Surlyn 8120 | 50 | 70 | 40 | 40 | | | 70 |

In Table 1, Surlyn and Himilan are the trade names of ionomer resin commercially available from E. I. duPont and Mitsui duPont Chemical K.K., respectively.

The golf balls were examined for flying performance, spin, and feeling by the following tests.

Flying test

Using a swing robot, the ball was hit by a driver (#1W) at a head speed of 35 m/sec. (HS35) for determining a carry, total distance, and angle.

Spin

Using a swing robot, the ball was hit by a sand wedge (#SW) at a head speed of 19 m/sec. and by a No. 7 iron (#7I) at a head speed of 30 m/sec. The behavior of the ball immediately after impact was observed by taking photographs. A spin rate was determined by photographic image analysis.

Feeling test

Five amateur players with a head speed of 35 m/sec. actually hit the ball to judge the hitting feel. The rating was "◎" for a very soft feel, "O" for a soft feel, and "Δ" for a rather hard feel.

The results are shown in Table 2.

TABLE 2

| | E1 | E2 | E3 | E4 | CE1 | CE2 | CE3 |
|---|---|---|---|---|---|---|---|
| Core hardness (mm) | 2.5 | 3.0 | 4.0 | 4.5 | 3.5 | 4.0 | 5.5 |
| Cover Shore D hardness | 50 | 48 | 53 | 53 | 55 | 69 | 48 |
| Ball weight (g) | 43.50 | 42.20 | 41.50 | 44.00 | 45.30 | 43.50 | 41.50 |
| #SW spin (rpm) | 5850 | 5923 | 5865 | 5710 | 5680 | 3952 | 5703 |
| #7I spin (rpm) | 6921 | 7030 | 6902 | 6894 | 6827 | 5047 | 6952 |
| #1W/HS35 | | | | | | | |
| Carry (m) | 148.1 | 148.2 | 147.8 | 148.5 | 146.0 | 147.5 | 143.0 |
| Total (m) | 163.3 | 162.0 | 161.8 | 163.0 | 161.0 | 161.5 | 157.5 |
| Angle (°) | 13.0 | 13.1 | 13.2 | 12.9 | 12.7 | 13.0 | 13.3 |
| Feel | ○ | ◎ | ◎ | ◎ | ○ | Δ | ◎ |

As is evident from Table 2, the golf ball of Comparative Example 1 having a greater weight did not fly a long distance and presented a less pleasant hitting feel and unsatisfactory spin. The ball of Comparative Example 2 showed less spin susceptibility, hard hitting feel and unsatisfactory flight distance since its cover was too hard. Although the ball of Comparative Example 3 presented pleasant hitting feel, its spin receptivity was insufficient and its flight distance was short, as compared with the ball of Example 3 having the identical ball weight, because the core was too soft and hence, the balance between core hardness and cover hardness is improper. In contrast, the golf balls of Examples 1 to 4 offered an increased flight distance, a high spin rate and pleasant hitting feel when hit at a low head speed of 35 m/sec.

Although some preferred embodiments have been described, many modifications and variations may be made thereto in the light of the above teachings. It is therefore to be understood that within the scope of the appended claims, the invention may be practiced otherwise than as specifically described.

We claim:

1. A solid golf ball comprising, a solid core and a cover wherein said cover has a Shore D hardness in the range of 40 to 53 said solid core has a hardness corresponding to a distortion of 3.0 to 5 mm under a load of 100 kg, and the ball has a weight in the range of 41 to 44.5 grams.

2. The solid golf ball of claim 1 wherein said golf ball has a weight in the range of 42 to 44 grams.

3. The solid golf ball of claim 1 wherein said cover has a hardness in the range of 43 to 53.

4. The solid golf ball of claim 1 wherein said cover has a radial thickness of 1.4 to 2.6 mm.

5. The solid golf ball of claim 1 wherein said solid core has a diameter in the range of 38 to 40 mm.

6. The solid golf ball of claim 1 wherein said solid core has a weight in the range of 24 to 37 grams.

* * * * *